US005651352A

United States Patent [19]

Terakado et al.

[11] Patent Number: 5,651,352

[45] Date of Patent: Jul. 29, 1997

[54] DISTRIBUTOR FOR INTERNAL COMBUSTION ENGINES

[75] Inventors: Takao Terakado; Masaru Ujigawa, both of Hitachinaka; Toshiaki Kaminaga, Ibaraki-ken, all of Japan

[73] Assignees: Hitachi, Ltd., Tokyo; Hitachi Automotive Engineering Co., Ltd., Katsuta, both of Japan

[21] Appl. No.: 378,180

[22] Filed: Jan. 25, 1995

[30] Foreign Application Priority Data

Jan. 26, 1994 [JP] Japan ..... 6-006853

[51] Int. Cl.[6] ..... F02P 7/073; F02P 7/077

[52] U.S. Cl. ..... 123/613; 123/633; 123/635

[58] Field of Search ..... 123/612, 613, 123/617, 647, 635, 633, 414

[56] References Cited

U.S. PATENT DOCUMENTS 5,024,185 6/1991 Fujita et al. ..... 123/647

5,139,003 8/1992 Ohhashi et al. ..... 123/635

FOREIGN PATENT DOCUMENTS

| | | |
|---|---|---|
| 58-187578 | 11/1983 | Japan . |
| 63-75356 | 4/1988 | Japan . |
| 2-27164 | 1/1990 | Japan . |
| 4-27724 | 1/1992 | Japan . |
| 4-59371 | 5/1992 | Japan . |
| 4-203358 | 7/1992 | Japan . |
| 5-195932 | 8/1993 | Japan . |

*Primary Examiner*—Andrew M. Dolinar

*Attorney, Agent, or Firm*—Bardehle, Pagenberg, Dost, Altenburg, Frohwitter, Geissler & Partners

[57] ABSTRACT

A distributor for internal combustion engines which includes a connector for electrically coupling a rotation signal detector and an engine control unit and a connector for electrically coupling an ignition coil and the engine control unit, the distributor being constructed to be able to improve working efficiency and productivity during assembly and handling easiness during maintenance.

20 Claims, 10 Drawing Sheets

DISTRIBUTOR FOR INTERNAL COMBUSTION ENGINES

BACKGROUND OF THE INVENTION

1. Field of the Invention

The present invention relates to a distributor for use with internal combustion engines of automobiles etc., and more particularly to a distributor for internal combustion engines which includes a plurality of connectors for electrically coupling the interior and the exterior of the distributor, and a rotation signal detector.

2. Description of the Related Art

In internal combustion engines of automobiles etc., generally, a low-voltage current introduced from a battery is converted by an ignition coil into a high-voltage current which is then supplied to a distributor. In the distributor, the high-voltage current is supplied by a distributing rotor to cylinder's spark plugs in sequence so that a spark is emitted to set off ignition in each of the cylinders.

Of late, there is a tendency to arrange parts necessary for ignition inside a distributor collectively from the standpoints of creating a space in the engine room and reducing the cost. An ignition coil for generating a high-voltage current, for example, is arranged inside the distributor. In this case, the following arrangements are proposed with a view of meeting demands from automobile manufacturers and users.

(1) Ignition Coil at Top of Distributor

As disclosed in JP, A, 63-75356, for example, a shaft rotating synchronously with an engine is vertically disposed, and an ignition coil is disposed on an extension of the shaft axis and at the top of a distributor. Further, a signal rotor rotatable with the shaft and a rotation signal detector of magnetism detecting type located to face the signal rotor are disposed in a lower portion of the distributor.

(2) Ignition Coil in Lower Portion of Distributor

As disclosed in JP, U, 4-59371, for example, an ignition coil is disposed in a lower portion of a distributor while a vertical shaft is penetrating the ignition coil. On the other hand, a signal rotor and a rotation signal detector of light detecting type are disposed in an upper portion of the distributor. Thus, the rotation signal detector and the ignition coil are arranged in a vertically two-layered structure.

(3) Rotation Signal Detector and Ignition Coil on Both Sides of Shaft

As disclosed in JP, A, 4-203358 and JP, A, 4-27724, for example, a signal rotor and a rotation signal detector of light detecting type are disposed nearly at the center of a distributor. The rotation signal detector and the ignition coil are disposed in opposite sides with a shaft therebetween.

The distributor of above (3) type has a connector for electrically coupling the interior and the exterior of the distributor. More specifically, as the signal rotor is rotated, the crank angle position of an engine is detected as an interrupted signal (hereinafter referred to as crank angle position signal) by the rotation signal detector, and the crank angle position signal is transmitted to an engine control unit through the connector. Upon receiving the crank angle position signal, the engine control unit outputs an ignition timing signal for the engine, which is introduced back to the distributor through the connector and then transmitted to the ignition coil through a lead.

At the same time, source power is supplied from the engine control unit to the ignition coil through electrical connection separately established from that made by the above connector. Such separate electrical connection is obtained by, e.g., connecting the engine control unit and the ignition coil directly through a lead as disclosed in JP, A, 4-203358. For further improved convenience in handling of parts, however, it is thought to provide another connector (hereinafter referred to also as second connector) for electrically coupling the ignition coil and the engine control unit separately from the above-mentioned connector (hereinafter referred to also as first connector) for electrically coupling the rotation signal detector and the engine control unit, as with the distributor of separate type (above (2) type) disclosed in JP, U, 4-59371. In this case, the ignition coil induces a high voltage at its output terminal from the source power supplied through the second connector in accordance with the timing that is determined by the ignition timing signal transmitted through the first connector.

In the distributor arranged described above, the first connector for electrically coupling the rotation signal detector and the engine control unit is structurally integral with the rotation signal detector. But the second connector for electrically coupling the ignition coil and the engine control unit is positioned near the ignition coil, i.e., on the side opposite to the rotation signal detector, and is structurally separate from the first connector and the rotation signal detector. In other words, because the first and second connectors are disposed in spaced opposite relation, the distributor must be turned upside down during assembly after attaching one of the connectors, in order to attach the other. This is disadvantageous from the viewpoint of working efficiency. Another disadvantage is that the number of steps is increased, which leads to a difficulty in achieving high productivity. Further, in the present situations where ignition parts are collectively disposed inside a distributor and the density of parts in the distributor is overly increased as described before, wire distribution from the separate connectors is unhandy to perform, which also impedes an improvement in working efficiency and productivity. Additionally, inconvenience in handling of parts is also suffered during maintenance for the same reason.

SUMMARY OF THE INVENTION

It is an object of the present invention to provide a distributor for internal combustion engines which includes a connector for electrically coupling a rotation signal detector and an engine control unit and a connector for electrically coupling an ignition coil and the engine control unit, the distributor being constructed to be able to improve working efficiency and productivity during assembly and handling easiness during maintenance.

To achieve the above object, according to the present invention, there is provided a distributor for internal combustion engines comprising a shaft rotating synchronously with a crankshaft of an engine, a signal rotor rotatable with the shaft, a rotation signal detector for detecting a rotating angle of the crankshaft from rotation of the signal rotor, and an ignition coil for applying a high voltage to an ignition plug of each of cylinders, wherein the distributor for internal combustion engines further comprises a first connector for electrically coupling an engine control unit outside the distributor and the rotation signal detector, and a second connector for electrically coupling the engine control unit and the ignition coil, the first connector and the second connector being each structurally integral with the rotation signal detector.

Preferably, there is provided a distributor for internal combustion engines wherein, in addition to the above arrangement, the first connector and the second connector are integrated into a single connector, and the single connector is structurally integral with the rotation signal detector.

Preferably, there is provided a distributor for internal combustion engines wherein, in addition to the above arrangement, the rotation signal detector incorporates an igniter for interrupting a primary current of the ignition coil to generate a high voltage in the ignition coil, and the first connector and the second connector are each structurally integral with the igniter.

Preferably, there is provided a distributor for internal combustion engines wherein, in addition to the above arrangement, the first connector and the second connector are integrated into a single connector, and the single connector is structurally integral with the igniter.

Preferably, there is provided a distributor for internal combustion engines wherein, in addition to the above arrangement, part of electric lines for connecting the second connector and the ignition coil is disposed in the rotation signal detector.

Preferably, there is provided a distributor for internal combustion engines, in addition to the above arrangement, further comprising a capacitor for preventing noise from being mixed into an on board radio which is disposed in the rotation signal detector.

In the present invention thus arranged, since the first connector for electrically coupling the engine control unit outside the distributor and the rotation signal detector and the second connector for electrically coupling the engine control unit and the ignition coil are each structurally integral with the rotation signal detector, the first and second connectors are located in positions close to each other. Therefore, both the connectors can be attached in place with no need of changing the distributor in its set direction during assembly. Also, wire distribution from both the connectors is facilitated. Furthermore, since not only the first connector but also the second connector are integral with the rotation signal detector, the number of parts is reduced in comparison with the prior art. As a result, working efficiency during assembly is increased, productivity is enhanced corresponding to the reduced number of steps, and handling easiness during maintenance is improved.

With the arrangement that the first connector and the second connector are integrated into a single connector which is structurally integral with the rotation signal detector, a wider space outside the distributor than available in the prior art can be ensured.

With the arrangement that the rotation signal detector incorporates an igniter and the first connector and the second connector are each structurally integral with the igniter, it is possible to improve working efficiency and productivity during assembly and handling easiness during maintenance in the distributor of the type having a built-in igniter as well.

With the arrangement that the first connector and the second connector are integrated into a single connector which is structurally integral with the igniter, a wider space outside the distributor than available in the prior art can be ensured.

With the arrangement that part of the electric lines for connecting the second connector and the ignition coil is disposed in the rotation signal detector, electrical connection between the engine control unit and the ignition coil through the second connector can be realized.

Additionally, with the arrangement that the capacitor for preventing noise from being mixed into the on board radio is disposed in the rotation signal detector, the number of parts disposed inside the distributor can be reduced in comparison with the prior art wherein the capacitor has been disposed as a separate part in the distributor.

BRIEF DESCRIPTION OF THE DRAWINGS

In FIGS. 1–10, the following reference numerals are used:

Figure 1:
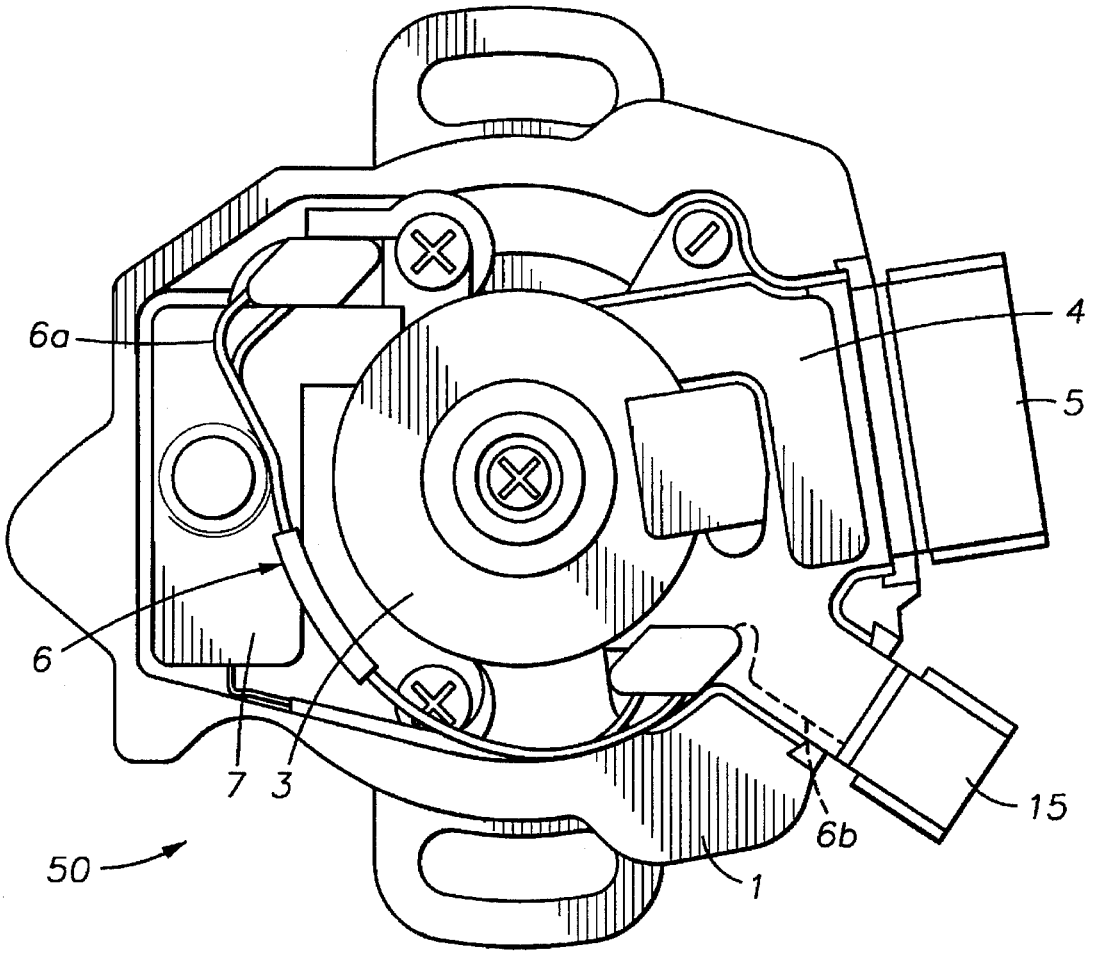
FIG. 1 is a plan view of a distributor for internal combustion engines according to a first embodiment of the present invention with a cap removed.

1 housing
15 connector
100 body
102 cylindrical portion
104 space
107 space
2 rotary shaft
25 connector
2A0 bearing
2A1 inner wheel
2A2 outer wheel
2A3,2A4 holding metalic parts
2A5 screw
2A6 female screw
2B coupling
2C pin
3 signal rotor
3A slit
4 rotation signal detector
40 rotation detector part
400 circuit unit
401 light emission element
402 light receiving element (PD)
403,404 through holes
405,406 screws
40A circuit receiving case part
40A1 circuit board
41,42,45–51 and L1–L4 connecting terminals
41*a*,42*a*,41*a*',42*a*' outer terminal
43 power transistor
44 circuit unit
48 power supply terminal
5 connector (first connector)
50 distributor
50*a* connecting pads
52 connection terminal
6 wiring (electric lines connecting second connector and ignition coil)
60 plastic case
63*a*,63*b* flexible metallic strips

64a and 64b receiving metalic parts
65a,65b insertion holes
6a lead wire
6b lead wire
7 ignition coil
7a high voltage tower
7a' high voltage lead wire
7b,7c screws
70 distributor
8 distributing cap
8a center electrode
80 distributor
9 rotor head
91 screw 91
9a distributing rotor
C/U control unit
$C_1$-C5,$C_{10}$,$C_{11}$,$C_{20}$ condensors
$C_{21}$ noise killer condensor
D diode
L inductance
P plugs
P-GND power ground
P1–P4 side electrodes
P1L–P4L high voltage distribution lines
$R_1$-$R_{11}$,$R_{20}$,$R_{21}$,$R_{23}$ resistors
$R_{22}$ current detecting resistor
TC1 primary winding
TC2 secondary winding
TH thermistor
TR1 transistor
TR2 transistor
VB battery
ZD zener diode

DESCRIPTION OF THE PREFERRED EMBODIMENTS

Hereinafter, embodiments of the present invention will be described with reference to FIGS. 1 to 10.

A first embodiment of the present invention will be described with reference to FIGS. 1 and 2.

Figure 2:
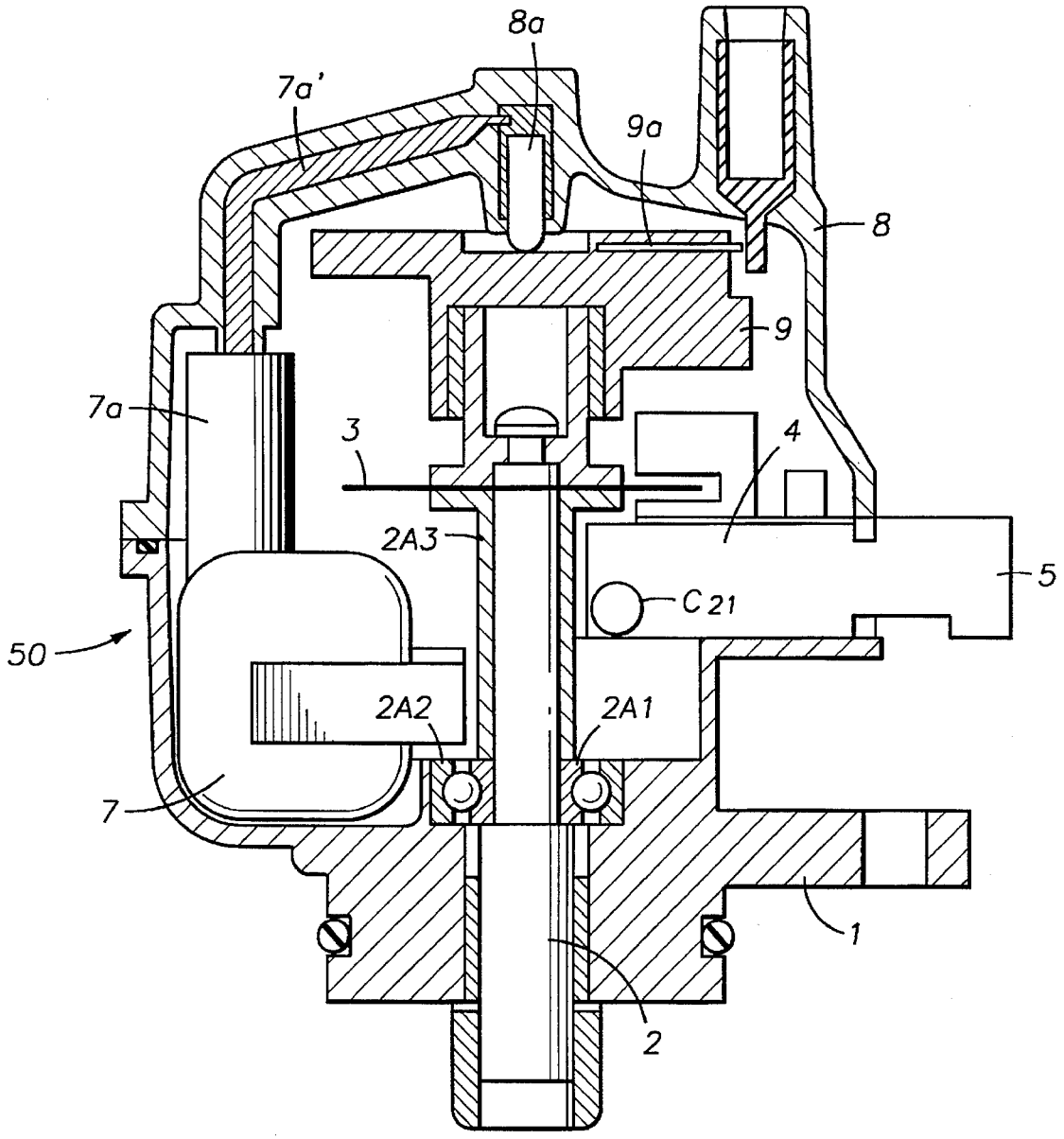
FIG. 2 is a vertical sectional view of the distributor for internal combustion engines indicated in FIG. 1.

A distributor for internal combustion engines according to this embodiment is shown in FIGS. 1 and 2. FIG. 1 is a plan view of the distributor for internal combustion engines with a cap removed, FIG. 2 is a vertical sectional view of the distributor for internal combustion engines.

In FIGS. 1 and 2, a distributor 50 of this embodiment comprises a housing 1, a rotary shaft 2 rotatably mounted in the housing 1 and rotating synchronously with a crankshaft of an engine (not shown), a signal rotor 3 mounted on the rotary shaft 2 to be rotated therewith, a rotation signal detector 4 mounted to the housing 1 for detecting a rotating angle of the crankshaft from rotation of the signal rotor 3, an ignition coil 7 mounted in a recess of the housing 1 near the rotary shaft 2 for applying a high voltage to an ignition plug of each of cylinders, a connector 5 for electrically coupling an engine control unit (not shown) outside the distributor 50 and the rotation signal detector 4, a connector 15 for electrically coupling the engine control unit and the ignition coil 7, and a cap 8 fixed to the top of the housing 1 so as to cover the above parts.

The connector 5 and the connector 15 are each structurally integral with the rotation signal detector 4. A wiring 6 for connecting the connector 15 and the ignition coil 7 consists of a lead wire 6a and a lead wire 6b built in the rotation signal detector 4. Thus, the engine control unit and the ignition coil 7 are electrically coupled to each other through a line comprising the engine control unit, the connector 15, the lead wire 6b, the lead wire 6a and the ignition coil 7 which are interconnected in this order. Also, the rotation signal detector 4 incorporates a condenser $C_{21}$ for preventing noise from being mixed into an on board radio.

In the above arrangement, when the rotary shaft 2 is rotated synchronously with the engine (not shown) and the signal rotor 3 is also rotated therewith, the rotation signal detector 4 detects an interrupted signal (i.e., a crank angle position signal) indicating the rotating angle position of the engine crankshaft, and the crank angle position signal is transmitted to the engine control unit (not shown) through the connector 5. Upon receiving the crank angle position signal, the engine control unit outputs an ignition timing signal for the engine, which is introduced back to the rotational signal detector 4 in the distributor 50 through the connector 5 and then transmitted to the ignition coil 7 through the lead wire 6a. At the same time, source power for ignition is output from the engine control unit and supplied to the ignition coil 7 through the connector 15, the lead wire 6b in the rotation signal detector 4 and the lead wire 6a. In addition, a tachometer signal is supplied to the engine control unit from the ignition coil 7 through the reverse course with the above-described course.

The ignition coil 7 induces a high voltage at its output terminal from the source power supplied through the connector 15 after passing the lead wire 6b and the lead wire 6a, in accordance with the timing that is determined by the ignition timing signal transmitted through the connector 5 after passing the rotation signal detector 4 and the lead wire 6a. As a result, the high voltage is applied to an ignition plug of each cylinder of the engine (not shown).

With this embodiment thus arranged, since the connector 5 and the connector 15 are each structurally integral with the rotation signal detector 4, both the connectors 5, 15 can be attached in place with no need of changing the distributor 50 in its set direction during assembly. Further, wire distribution from both the connectors 5, 15 is facilitated and the number of parts is reduced. Therefore, working efficiency during assembly is increased, productivity is enhanced corresponding to the reduced number of steps, and handling easiness during maintenance is improved. It is thus possible to reduce the cost of the distributor and to improve reliability.

Additionally, since the condenser $C_{21}$ for preventing noise from being mixed into the on board radio is built in the rotation signal detector 4, the number of parts disposed inside the distributor can be reduced in comparison with the prior art wherein the capacitor has been disposed as a separate part in the distributor.

In the above embodiment, the connectors 5, 15 are structurally integral with the rotation signal detector 4. However, when the distributor is of the type that an igniter for interrupting a primary current of the ignition coil 7 to generate a high voltage in the ignition coil is built in the rotation signal detector 4, the connectors 5, 15 may be structurally integral with the igniter. This case can also provide similar advantages as above.

A second embodiment of the present invention will be described with reference to FIG. 3.

Figure 3:
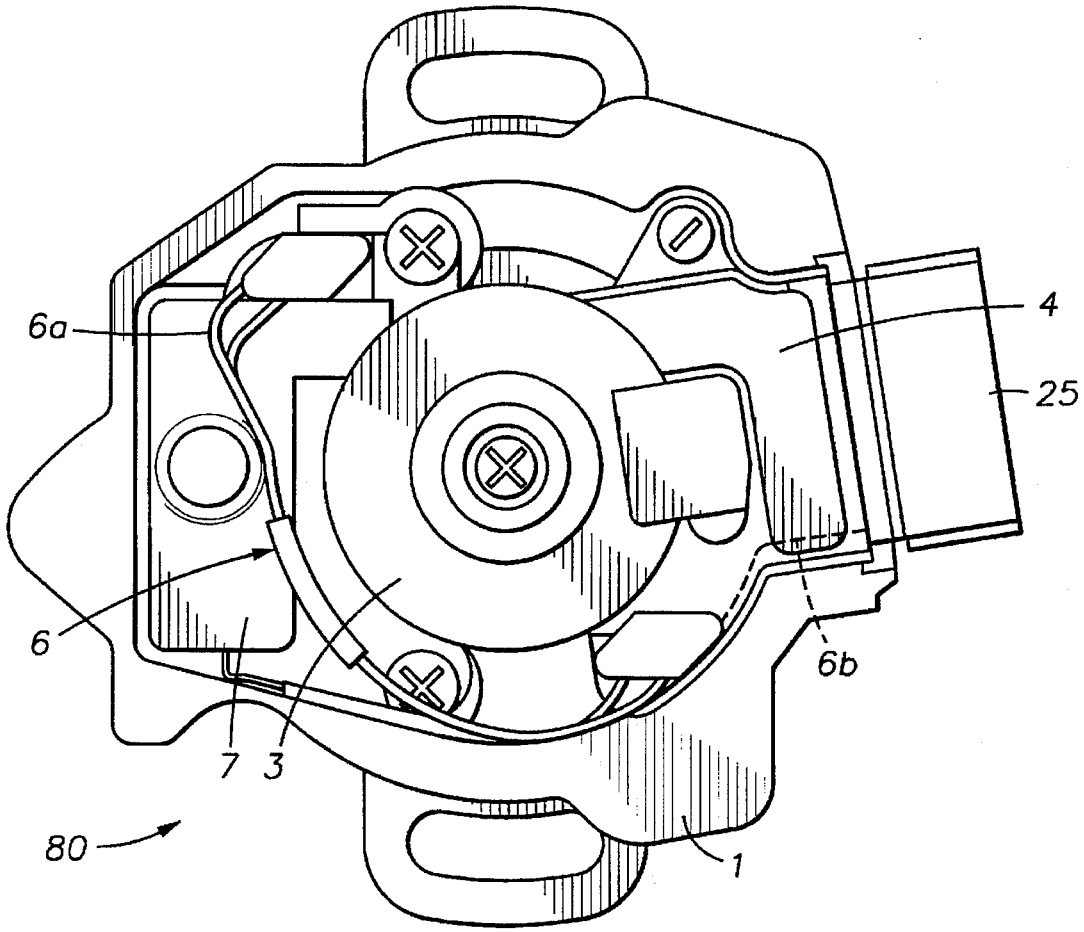
FIG. 3 is a plan view of a distributor for internal combustion engines according to a second embodiment of the present invention with a cap removed.
Figure 4:
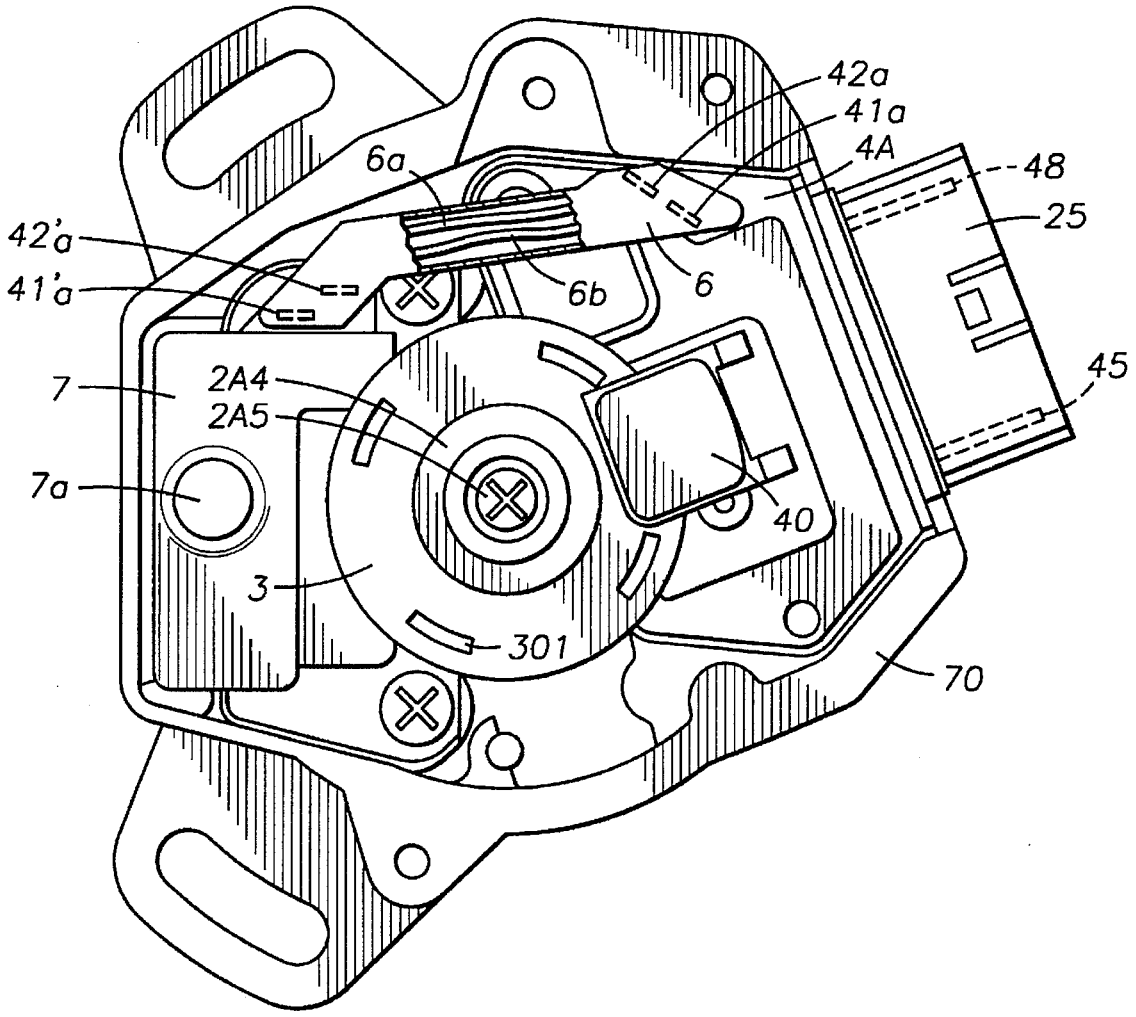
FIG. 4 is a plan view of a distributor for internal combustion engines according to a third embodiment of the present invention with a cap removed.

FIG. 3 shows a top plan of a distributor for internal combustion engines according to this embodiment with a cap removed. Identical parts to those in the distributor 50 of the first embodiment are denoted by the same reference numerals.

In FIG. 3, a distributor 80 of this embodiment is different from the distributor 50 of the first embodiment in that a connector for electrically coupling the engine control unit (not shown) outside the distributor and the rotation signal detector 4 and a connector for electrically coupling the engine control unit and the ignition coil 7 are integrated into a single connector 25 which is structurally integral with the rotation signal detector 4. The remaining structure is substantially the same as in the distributor 50 of the first embodiment.

With this embodiment, in addition to the advantage obtained by the first embodiment, a wider space outside the distributor than available in the prior art can be ensured.

This embodiment can also be modified in a like manner to the first embodiment. Specifically, when the distributor is of the type having an igniter built in the rotation signal detector 4, the connector 25 may be structurally integral with the igniter. In this case, similar advantages as above can also be provided.

A third embodiment of the present invention will be described in detail with reference to FIGS. 4 to 10.

In the third embodiment, the construction for connecting an ignition coil and a power switch circuit is improved.

To this end, a power supply terminal 48 in the connector 25 is positioned at the end portion which is the reverse end portion in the first and second embodiments. Other portions or members of the third embodiment are equal to those of the first and the second embodiments. Therefore, the description described hereinafter is common to all embodiments of the present invention.

The concrete construction of the distributor 70 of these embodiments will be described with reference to FIG. 5.

Whole configuration of a body 100 made of aluminum is cup-like shape. A cylindrical portion 102 is formed at the center portion of the body 100. The rotary shaft 2 penetrates the cylindrical portion 102. Space 104 defined by a bottom receiving a circuit unit 400 and space 107 defined by a bottom receiving an ignition coil 7 are respectively formed around the cylindrical portion 102.

A circuit unit 400 includes a circuit receiving case part 40A, a connector 25 part receiving connecting terminals and a rotation detector part 40 which are molded integrally with a resin.

Figure 6:
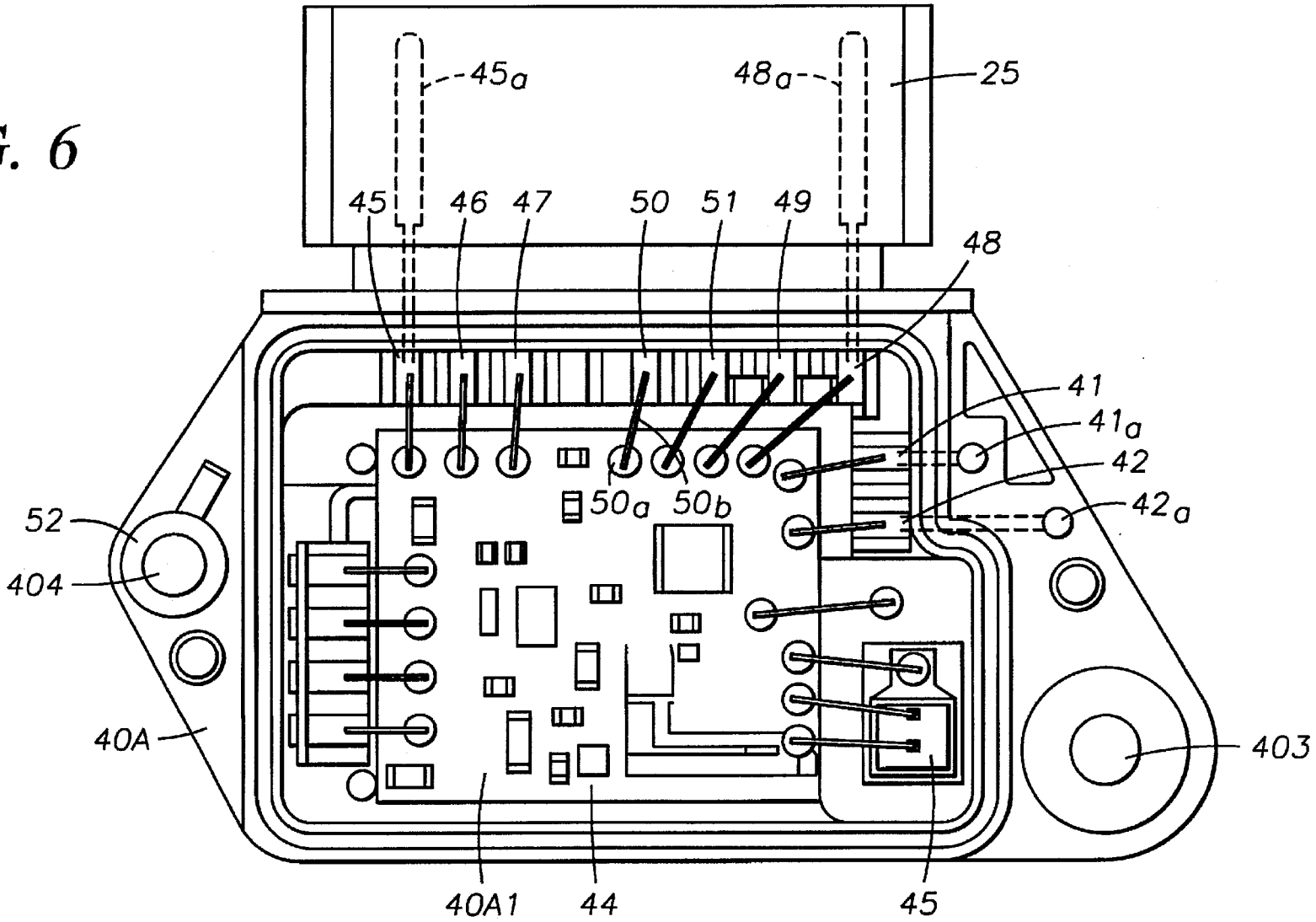
FIG. 6 is a plan view showing the details of the circuit unit and connector.

The circuit receiving case 40A receives a circuit board 40A1 in which a plurality of circuit elements are installed as shown in FIG. 6. Further, connecting terminals 41, 42, 45 to 51 and $L_1$ to $L_4$ are molded on the resin portion of the case, so that these terminals are positioned at the peripheral portions of the circuit board 40A1. Connecting pads made of aluminum represented by small circles (for example, represented by reference numeral 50*a*) are formed at positions corresponding to the connecting terminals.

Predetermined connecting terminals and the connecting pads are connected by using a wire bonding apparatus through connecting wires represented by thin lines (for example, reference numeral 50*b*).

The connecting terminals 41 and 42 are connected to the outer terminals 41*a* and 42*a*, the connecting terminals 45 to 51 being connected to the outer terminals 45*a* to 51*a* (not shown, except for 45*a* and 48*a*) in the connector 25 respectively.

Figure 7A:
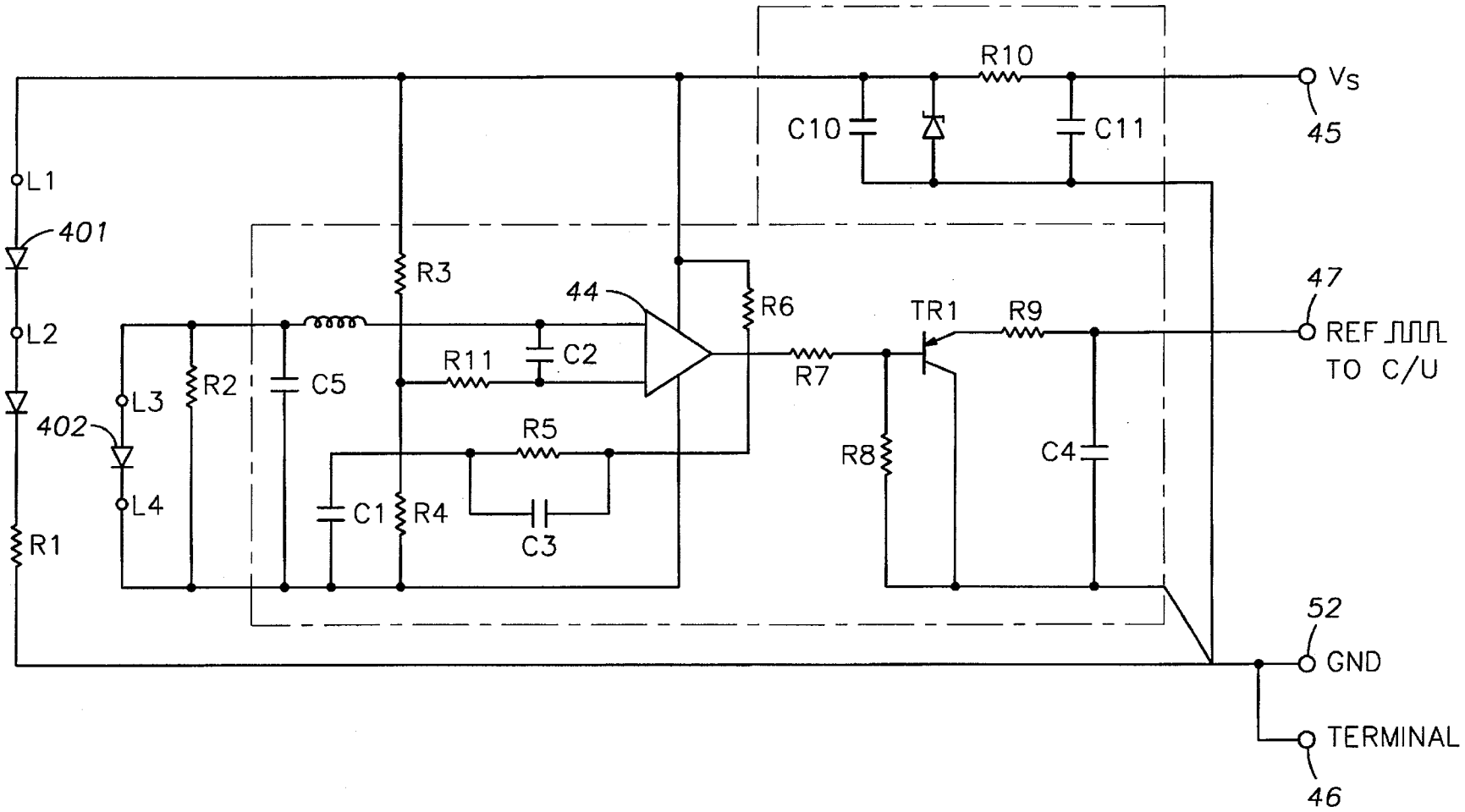
FIGS. 7A and 7B are circuit diagrams of the circuit included in the circuit unit shown in FIG. 6.

A plurality of circuit elements are connected with printed wiring on the back side of the circuit board as shown in FIG. 7 (A) and (B). Same reference numerals in the circuits as shown in FIG. 7 (A),(B) and FIG. 6 represent the same elements.

The rotation detector 40 includes a light emission element (LED) 401 and a light receiving element (PD) 402 which are arranged on a holder made of resin and are opposite with each other through a predetermined gap.

Each of the terminals of the light emission element (LED) 401 and the light receiving element (PD) 402 is connected to the connecting terminals $L_1$ to $L_4$ formed on the circuit receiving case 40A, being connected to a pulse wave shaping circuit of a crank angle detecting circuit through the connecting wires and connecting pads formed on the circuit board 40A1 as shown in FIG. 7.

In FIG. 7 (A) and (B), resisters $R_1$ to $R_{11}$, $R_{20}$, $R_{21}$, $R_{23}$ and a temperature compensating thermistor TH are made of printed resisters, being printed on the back side (not shown) of the circuit board 40A1.

Reference numerals $C_1$ to $C_5$, $C_{10}$, $C_{11}$, $C_{20}$ and $C_{21}$ represent condensers.

Reference numeral L represents a inductance, constructing a time constance circuit with the condenser $C_5$ and the resister $R_2$. The inductance L includes the function for applying the voltage of the condenser $C_5$ charged by the alternating current component of the output voltage from the light receiving element PD to the minus terminal of the integrated circuit 44 which is used as a comparator. Reference numerals $C_1$ to $C_4$ represent condensers for removing alternating current components superimposed on signals.

The integrated circuit 44 used as a comparator compares the voltage of the condenser $C_5$ with the reference voltage applied to the plus terminal of the circuit 44. The integrated circuit 44 judges whether the voltage of the condenser $C_5$ is more than the reference voltage or not, changing it's output condition in accordance with the above judgement to turn on and off the transistor TR1, so that the pulse-like rectangular wave voltage is output to the connecting terminal 47.

Reference numeral D represents a diode preventing reverse current, and the diode D protects the light emission element LED.

Reference numeral ZD represents a Zener diode functioning as a stabilizer of the power supply voltage input to the connecting terminal 45.

The connecting terminal 46 is connected to the ground terminal 52 formed on the circuit receiving case 40A, functioning as a ground terminal of the control unit C/U.

The ground terminal 52 is contacted to the aluminum body 100, being grounded when the circuit unit 400 is mounted to the body 100.

The condensers $C_{10}$ and $C_{11}$ function as a removing condensers for removing noise superimposed on the power supply voltage or current.

The crank angle detecting circuit is constructed from the light receiving/emitting elements, pulse wave shaping circuit and a stabilizer.

The ignition signal is input to the base of the power transistor 43 from the control unit C/U through the connecting terminal 51.

The power transistor 43 is turned on while the ignition signal exists, and the current flows to the P-GND point of the engine body (refer to FIG. 9) as a power ground from the battery VB through the connecting terminal 48, lead wire 6*b*, primary winding $TC_1$ of the ignition coil, lead wire 6*a*, power transistor 43, current detecting resister $R_{22}$ and connecting terminal 50.

When the ignition signal disappears, the power transistor 43 is turned off at the same time, and the high voltage is induced at the secondary winding $TC_2$ of the ignition coil.

The above high voltage is applied to one of the plugs P through the high voltage tower 7*a* of the ignition coil 7, high voltage lead wire 7*a*' of the distributing cap 8 (described hereinafter), center electrode 8*a*, distributing rotor 9*a*, side electrodes $P_1$ to $P_4$ and high voltage distribution lines $P_1L$ to $P_4L$.

At this time, high frequency noise is generated in the circuit of the primary circuit in which the above-mentioned primary current flows, being removed by the noise killer condenser $C_{21}$ one end of which is connected between the connecting terminal 48 and the outer terminal 41*a*.

Figure 8:
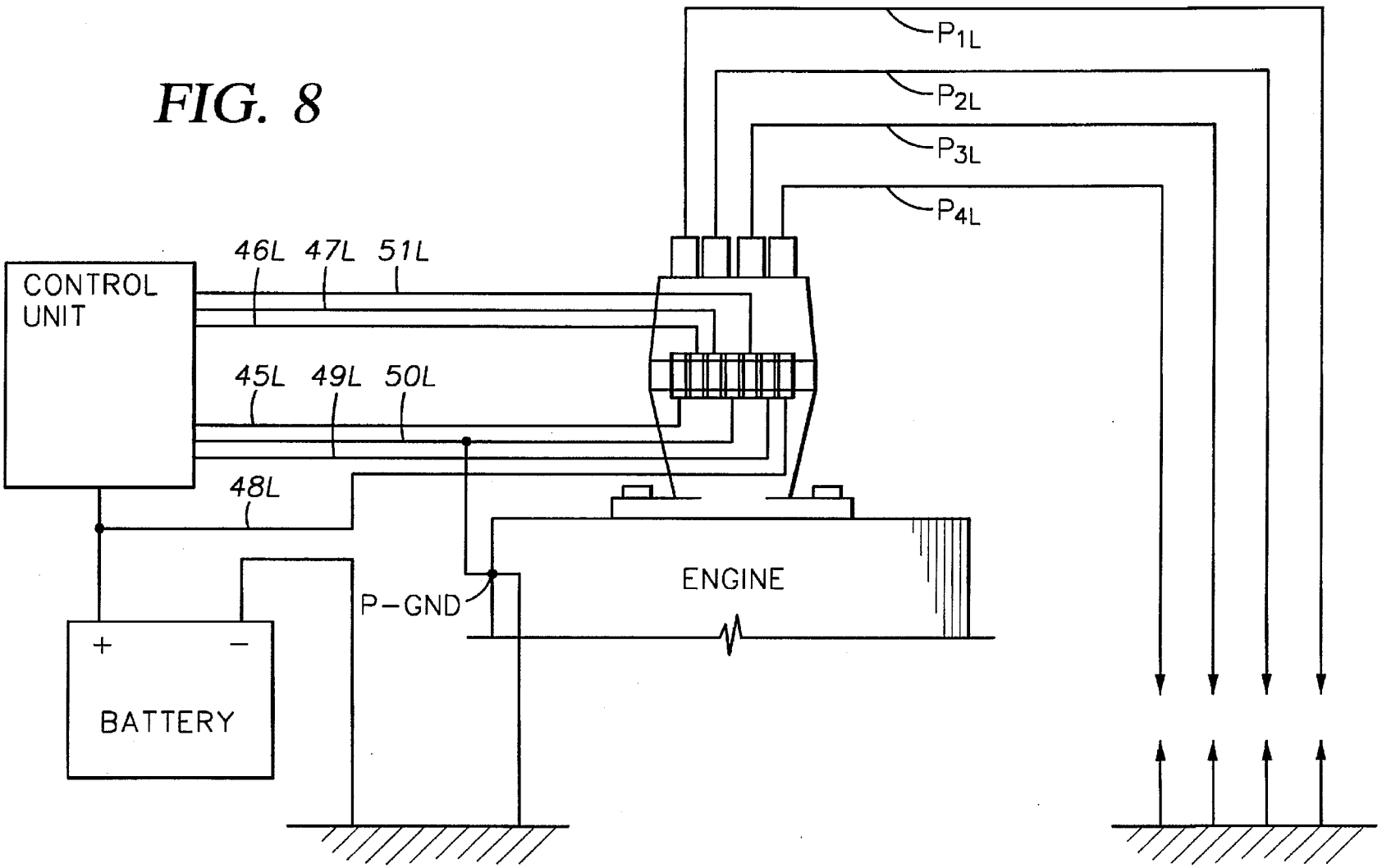
FIG. 8 is a black level schematic of the connections between the engine, control unit and battery.
Figure 9:
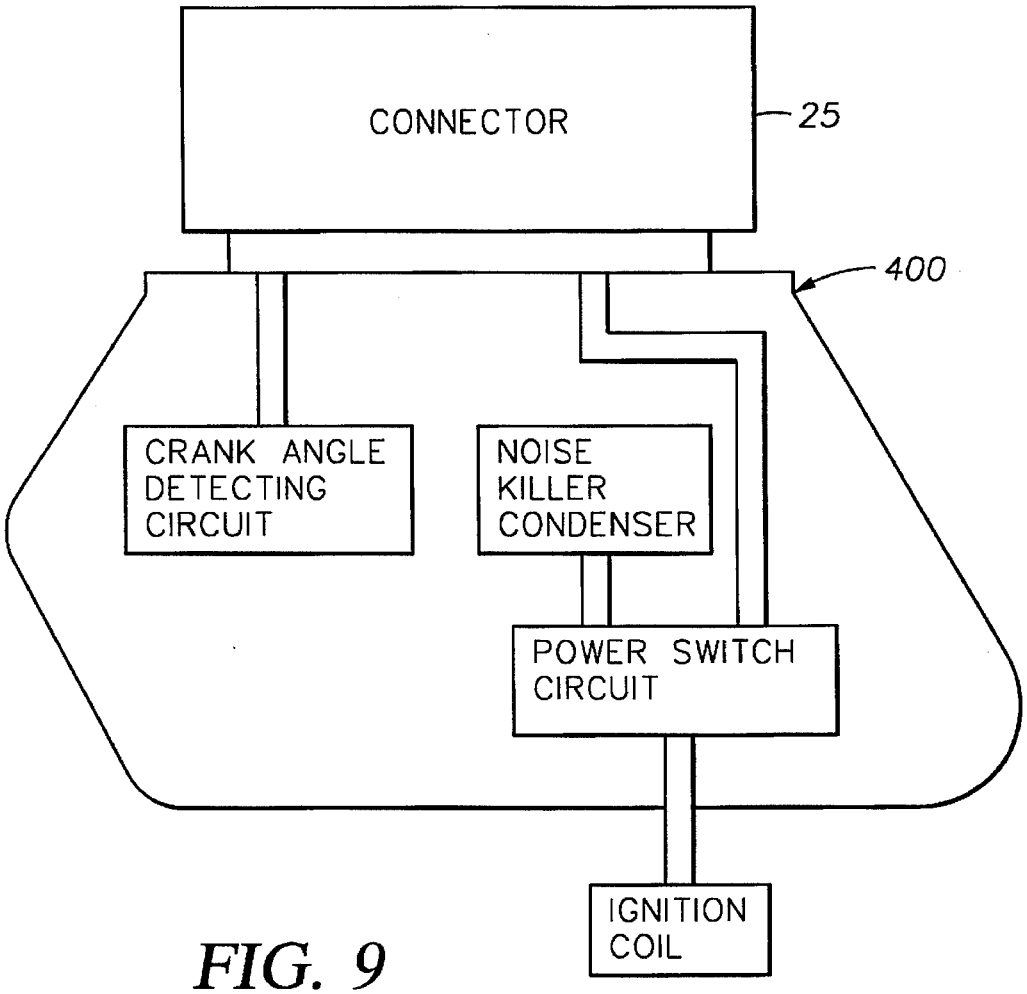
FIG. 9 is a block level schematic of the transmission of signals between the connector, circuit unit and ignition coil.
Figure 10:
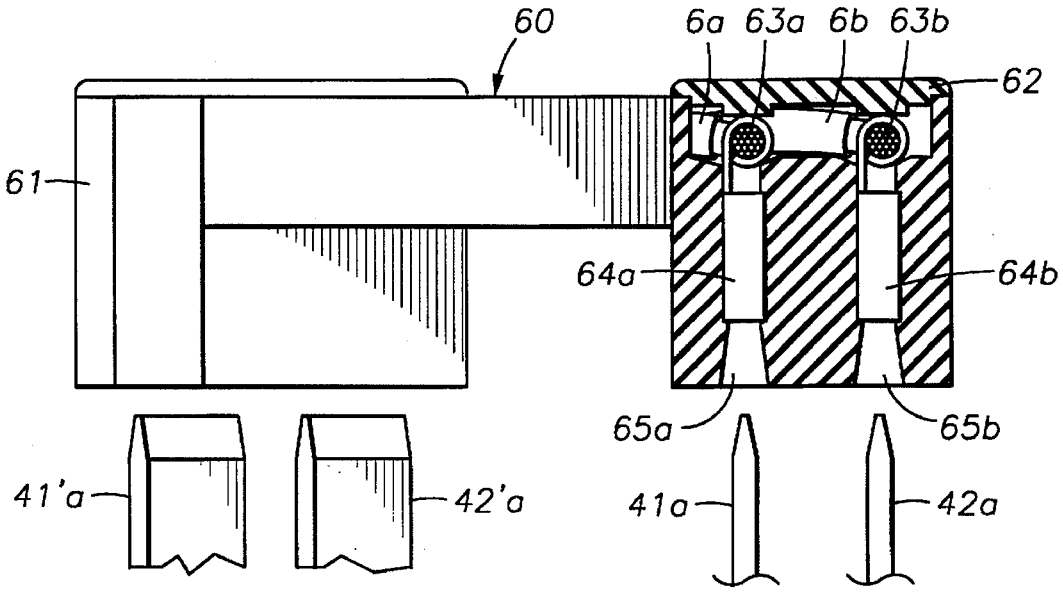
FIG. 10 is a partially sectional view showing the details of the plastic case shown in FIG. 5.

As shown in FIG. 8, the terminals 45 to 51 formed on the connector 25 of the distributor are connected to the control unit C/U, battery VB and power ground P-GND of the engine body respectively through the outer lead wires 45L to 51L.

Reference numeral 60 (see FIG. 10) represents a plastic case in which the lead wires 6*a* and 6*b* are held. Pairs of receiving metallic parts 64*a* and 64*b* are formed in both end portions of the plastic case. The outer terminals 41*a*, 42*a*, 41'*a* and 42'*a* are inserted into the receiving metallic parts which form a connector portion for connecting the outer terminals.

Flexible metallic strips 63*a* and 63*b* are fixed at the end portions of the lead wires 6*a* and 6*b*, each having a terminal receiving metallic parts 64*a* and 64*b* and a crimp portion to engage the strands of the lead wires and to electrically connect the lead wires and metallic strips. Reference numerals 65*a* and 65*b* represent insertion holes.

Accordingly, lead wires 6*a* and 6*b* are rigidly held in the distributor, so that the lead wires are not contacted with the signal rotor 3. Further, the lead wires can be connected by using same manner of the outer 4 terminals, so that wiring working can be simplified.

Since the direction of the current flowing through the lead wire 6*a* is opposite direction of the current flowing through the lead wire 6*b*, the magnetic fields generated by the change of the currents are canceled with each other. Therefore, electromagnetic noise can be restricted.

Primary current is detected as the terminal voltage of the current detecting resister $R_{22}$. When the terminal voltage exceeds a predetermined voltage and the current is started to flow, the transistor $TR_2$ is turned on. Therefore, the base current of the power transistor is reduced, and the increase of the primary current is restricted.

The action of the temperature compensation thermistor resistance TH is compensated and not influenced from temperature change.

The through holes 403 and 404 are formed on the flange portion of the circuit unit 400, and the screws 405 and 406 are inserted and screwed to the distributor body 100 through the holes 403 and 404 to fit the circuit unit 400 to the body 100.

The through holes are formed on the flange portion of the ignition coil 7, and the screws 7*b* and 7*c* are inserted and screwed to the distributor body 100 through the holes.

The inner wheel 2A1 of the bearing 2A0 is pressed and fixed to the rotary shaft 2, and the outer wheel 2A2 of the bearing 2A0 is pressed and fixed to the inner wall of the cylindrical portion at the center of the distribution body 100.

Further, the signal rotor 3 is sandwiched from the upper and lower directions with the holding metallic parts 2A3 and 2A4. The rotary shaft 2 is inserted into the signal rotor 3 with the holding metallic parts. The screw 2A5 is screwed into the female screw 2A6 formed at the top end of the rotary shaft 2, so that the signal rotor 3 and the like are fixed to the rotary shaft 2.

The top end of the upper holding metallic part 2A4 is covered with a rotor head 9 fixed to the metallic part 2A4 with a screw 91.

The slit 3A formed on the signal rotor 3 is positioned between the light emission element 401 and the light receiving element 402 of the rotation detector 40 when the signal rotor 3 is fixed to the rotary shaft 2. The slit 3A passes between the light emission element 401 and the light receiving element 402 when the signal rotor 3 is rotated.

The lower end portion of the rotary shaft 2 is inserted into a coupling 2B, and the coupling 2B is fixed to the rotary shaft 2 with a pin 2C. The rotation of the camshaft of the engine is transferred to the rotary shaft 2 through the protrusions formed on the coupling 2B.

The cross sectional yew of the above-mentioned construction is shown in FIG. 2.

Figure 5:
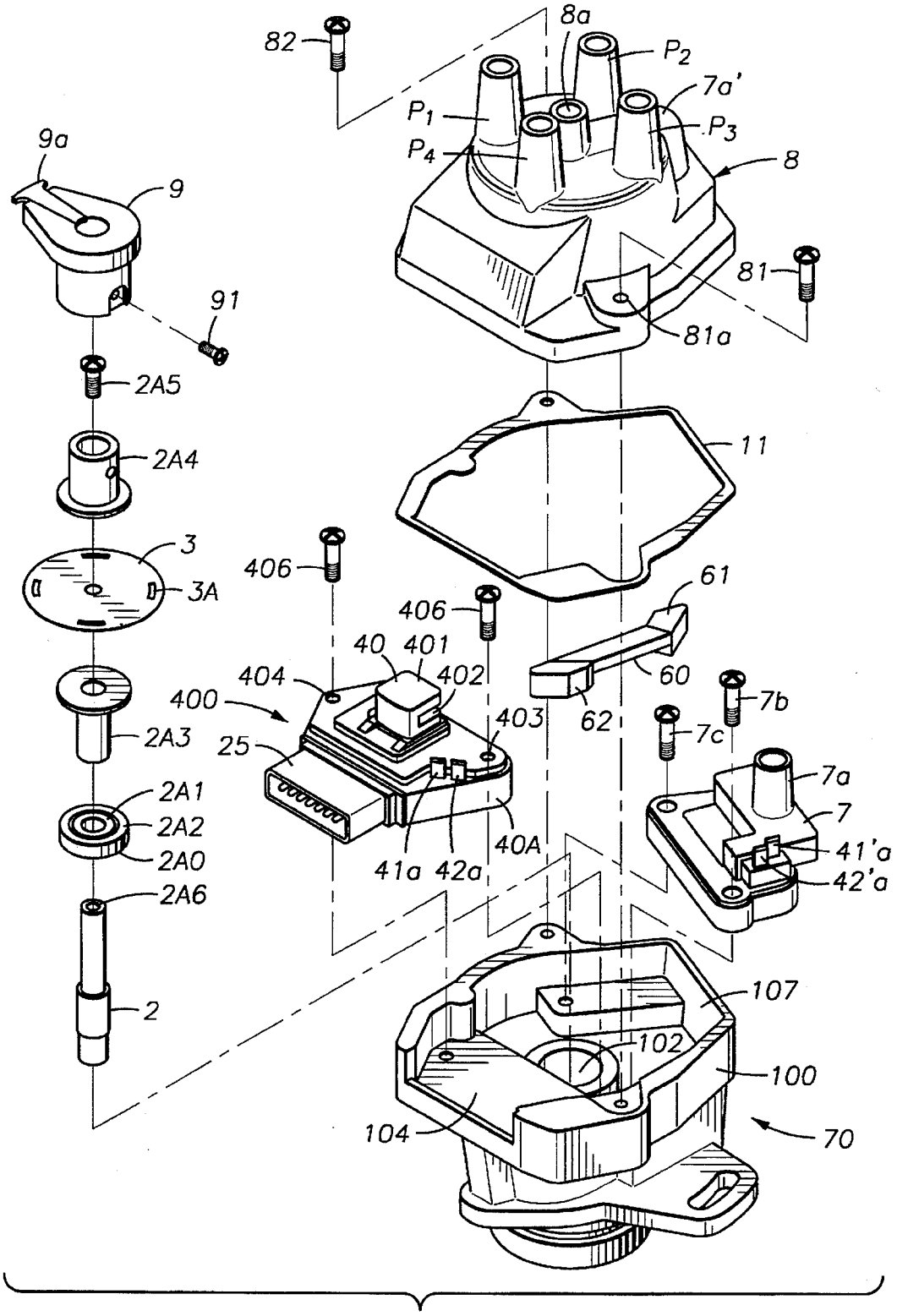
FIG. 5 is an exploded perspective view of the distributor shown in FIG. 4.
Figure 7B:
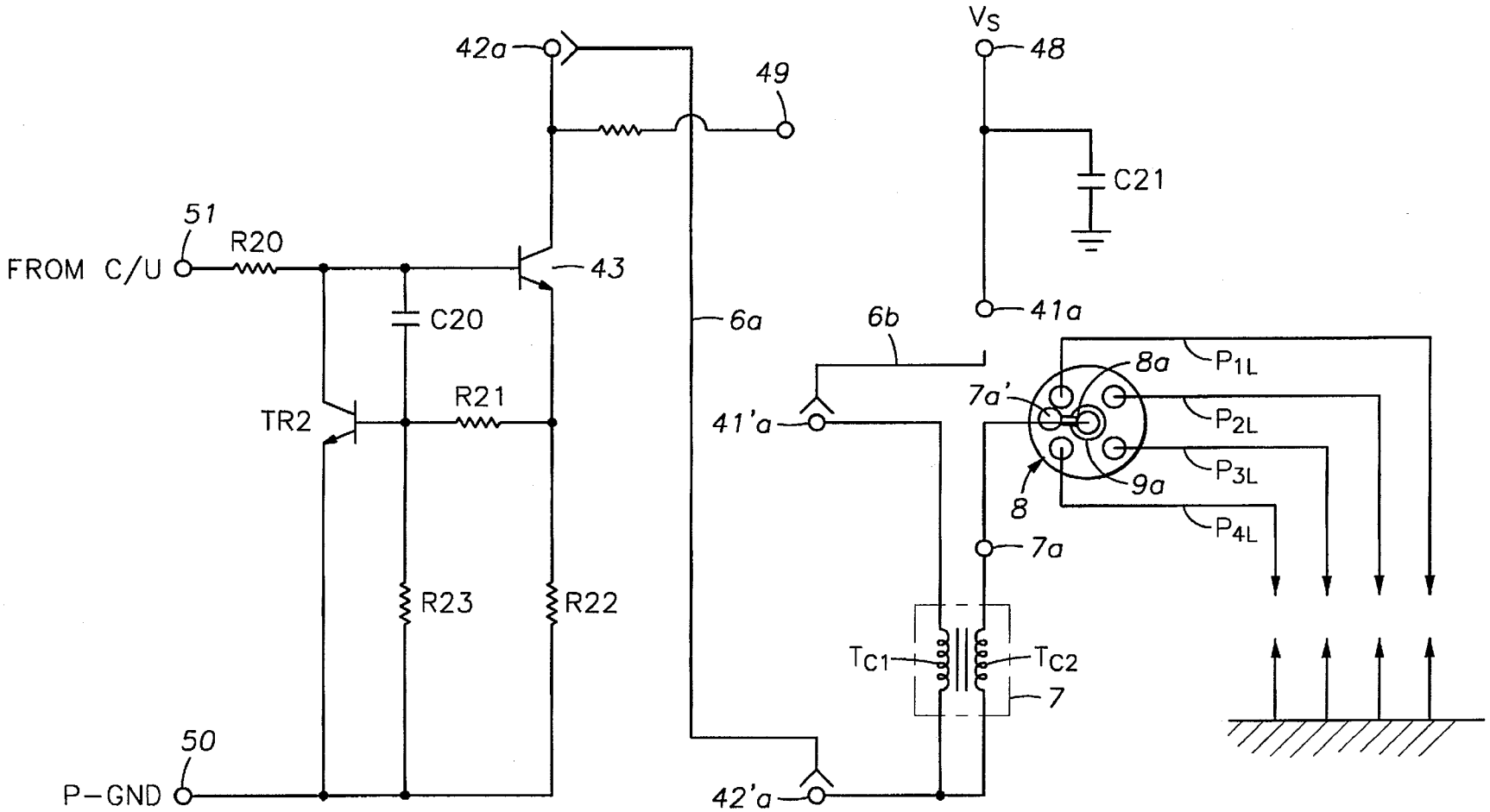

The distributor cap 8 includes a center electrode 8*a* disposed at its center portion as shown in FIG. 2, including side electrodes P1 to P4 arranged at regular intervals on the peripheral area of the electrode 8 (refer to FIGS. 5 and 7B).

The center electrode 8*a* is connected to the high voltage lead wire 7*a*'. The one end portion of the high voltage lead wire 7*a*' extends to the position opposing to the electric terminal at the top end of the high voltage tower 7*a* of the ignition coil 7. When the cap is mounted on the body 100, the high voltage lead wire 7*a*' and the electric terminal are electrically connected with each other.

The center electrode 8*a*, side electrodes P1 to P4 and high voltage lead wire 7*a*' are integrally molded in the cap 8 when the distributor cap 8 is molded with resin.

The side electrodes P1 to P4 are opposed to the electrode 9*a* of the rotary distribution rotor 9 with a small gap. When the electrode of the distributor rotor 9*a* approaches to one of the side electrodes P1 to P4, a high voltage from the ignition coil 7 is supplied to the one of the side electrodes.

The side electrodes P1 to P4 include connecting receptacles protruding in the upper and outer direction of the distributor cap 8. The connecting plugs of the outer high voltage lead wires P1L to P4L are inserted into the receptacles, so that the side electrodes and the outer high voltage lead wires are connected.

The distributor cap 8 is mounted on the distributor body 100. Then, the screws 81 and 82 are inserted into the through hole 81*a* (82*a* not shown) of the cap 8, being screwed into the female screws of the body 100 to fix the cap 8 on the body 100.

In this case, a seal packing 11 is inserted between the connecting surfaces of the body 100 and cap 8 in order to prevent water or dust from penetrating into the body 100, so that the circuit unit 400 and the ignition coil 7 are protected from the short circuit or leak caused by water or dust.

The cross sectional view of the above-mentioned construction is shown in FIG. 2.

As described above, according to the first embodiment of the present invention, the connecting terminals for connecting circuit unit 400 and control unit, circuit unit 400 and battery, and circuit unit 400 and ignition coil are integrally molded to the resin case part of the circuit unit 400.

Therefore, the wiring working can be simplified remarkably.

According to the second embodiment of the present invention, the ignition noise killer condenser $C_{21}$ is disposed in the vicinity of the connecting terminals 48 connected to the power supply VB and the connecting terminals 41 and 42 connected to the ignition coil on the circuit board 40A1.

The distance of the wiring from the terminals to the condenser $C_{21}$ can be shortened, so that portions of the wiring in which noise may be generated can be reduced and the noise can be restricted.

According to the third embodiment of the present invention, the connecting lead wiring between the outer terminals 41*a* and 41*b* of the power switch circuit and the ignition coil primary side connecting terminals 41'*a* and 42'*a* are mounted in the rigid case made of resin, the receiving metallic parts of the terminals are fixed to the end portion of the case. Therefore, the terminals 41*a* and 42*a* can be connected to the terminals 41'*a* and 42'*a* with simple operation.

There are variations of the arrangement of the outer terminals in the connector 25. Namely, the outer terminals can be arranged as the arrangement of the first embodiment or second embodiment. The inner wiring construction can be changed suitably in accordance with the outer terminals arrangement variation.

According to the present invention, since the first connector and the second connector are each structurally integral with the rotation signal detector, both the connectors can be attached in place with no need of changing the distributor in its set direction during assembly. Further, wire distribution from both the connectors is facilitated and the number of parts is reduced. Therefore, working efficiency during assembly is increased, productivity is enhanced corresponding to the reduced number of steps, and handling easiness during maintenance is improved. It is thus possible to reduce the cost of the distributor and to improve reliability.

Also, since the first connector and the second connector are integrated into a single connector which is structurally integral with the rotation signal detector, a wider space outside the distributor than available in the prior art can be ensured. As a result, working efficiency and handling easiness can be further improved. Additionally, since a capacitor for preventing noise from being mixed into an on board radio is built in the rotation signal detector, the number of parts disposed inside the distributor can be reduced in comparison with the prior art wherein the capacitor has been disposed as a separate part in the distributor.

What is claimed is:

1. A distributor for internal combustion engines comprising:

an ignition coil;

a circuit unit, said circuit unit including a connector molded integrally into said circuit unit, a rotation detector molded integrally into said circuit unit, wherein said rotation detector is responsive to the rotation of a crankshaft of the engines and is electrically coupled to a control unit by said connector, and a power switch circuit, mounted into said circuit unit, wherein said power switch circuit is electrically coupled to said control unit by said connector, and electrically coupled to said ignition coil;

a first connecting terminal molded integrally into said circuit unit and electrically coupled to said power switch circuit;

a second connecting terminal, electrically coupled to said ignition coil; and a case having a first end portion electrically coupled to a second end portion, each end portion having a receiving metallic part formed therein, wherein said first connecting terminal is inserted into said first end portion and said second connecting terminal is inserted into said second end portion electrically coupling said power switch circuit to said ignition coil.

2. A distributor for internal combustion engines according to claim 1, wherein said rotation detector incorporates an igniter for interrupting a primary current of said ignition coil to generate a high voltage in said ignition coil.

3. A distributor for an internal combustion engine comprising:

a housing enclosing a shaft rotating synchronously with a crankshaft of an engine;

a signal rotor rotatably fixed to the shaft within said housing;

an ignition coil within said housing for applying high voltage to an ignition plug of each cylinder of said engine;

electrical circuit means having integral therewith a first electrical connector means, rotation detector means, and power switch circuit means, said rotation detector means detecting a rotating angle of the crankshaft from rotation of the signal rotor and being electrically connected to an external engine control unit through said first electrical connector means, said power switch circuit means being electrically connected to said engine control unit through said first electrical connector means; and a second electrical connector means electrically connecting said power switch circuit means to said ignition coil, said second electrical connector means having an insulative case with first and second spaced end portions, each end portion having an electrical receptacle terminal means therein electrically connected to like terminal means at the other end portion, one end portion receiving that portion of said first electrical connector means connected to said power switch circuit means and the other end portion electrically connected to said ignition coil.

4. A distributor for an internal combustion engine according to claim 3 comprising a condenser molded integrally into said electrical circuit means and electrically coupled to said power switch circuit for suppressing electrical noise generated thereby.

5. A distributor for an internal combustion engine according to any one of claims 3–4 wherein said rotation detector includes means for interrupting a primary current of said ignition coil to generate a high voltage in said ignition coil.

6. A distributor for internal combustion engines according to claim 5 wherein said first electrical connector means, said rotation signal detector, and said electrical circuit means are molded into an integral unit.

7. A distributor for an internal combustion engine comprising:

a shaft rotating synchronously with a crankshaft of said engine;

a signal rotor fixed to and rotatable with said shaft;

an ignition coil assembly having an ignition coil for applying a high voltage to an ignition plug of each cylinder of said engine, and a housing enclosing said coil with electrical terminals connected to said coil and projecting from said housing;

a circuit unit assembly having first electrical connector means, rotation detector means, and power switch circuit means each electrically connected to electrical circuit means, and circuit housing means enclosing said electrical circuit means with said first electrical connector means and said rotation detector means molded integrally into said circuit housing means, said rotation detector means being responsive to rotation of a crankshaft of the engine for detecting a rotating angle of said crankshaft from rotation of said signal rotor, said rotation detector means and said power switch circuit means being electrically connected through said first electrical connector means to an external engine control unit;

second electrical connecting means electrically connecting said power switch circuit means to said ignition coil assembly, said second electrical connecting means having a case with first and second spaced end portions, each end portion having at least one electrical receptacle terminal therein, each said terminal electrically connected to like terminals at the other end portion of said case wherein said first connecting terminal is inserted into said first end portion and said second connecting terminal is inserted into said second end portion, thereby electrically coupling said power switch circuit to said ignition coil.

8. A distributor for internal combustion engines according to claim 7 wherein said rotation signal detector incorporates means for interrupting a primary current of said ignition coil to generate a high voltage in said ignition coil.

9. A distributor for internal combustion engines according to any one of claims 7–8 further comprising a condenser means connected to suppress noise generated from said rotation signal detector.

10. A distributor for internal combustion engines comprising:

a shaft rotating synchronously with a crankshaft of an engine, a signal rotor rotatable with said shaft, a rotation signal detector for detecting a rotating angle of said crankshaft from rotation of said signal rotor, and an ignition coil for applying a high voltage to an ignition plug of each of cylinders, wherein:

said distributor further comprises a circuit board provided with a plurality of circuit elements and electrically coupled to each of said ignition coil and an engine control unit outside said distributor; and a circuit receiving case receiving said circuit board, said rotation signal detector mounted in said circuit receiving case with said circuit board, said circuit receiving case formed integral with a first plug-in connecting terminal connecting said circuit board to said ignition coil, a second plug-in connecting terminal connecting said circuit board to a power supply for igniting outside said distributor, and a third plug-in connecting terminal connecting said circuit board to said engine control unit.

11. A distributor for internal combustion engines according to claim 10, further comprising a connector outside said circuit receiving case, a first outer plug-in connecting terminal located in said connector and connected to said second plug-in connecting terminal, and a second outer terminal located in said connector and connected to said third plug-in connecting terminal, wherein said power supply for igniting is positioned in said engine control unit, and said connector is formed integral with said circuit receiving case and connecting said first and second outer terminals to said engine control unit.

12. A distributor for internal combustion engines comprising a shaft rotating synchronously with a crankshaft of an engine, a signal rotor rotatable with said shaft, a rotation signal detector for detecting a rotating angle of said crankshaft from rotation of said signal rotor, and an ignition coil for applying a high voltage to an ignition plug of each of cylinders, wherein:

said distributor further comprises a circuit board provided with a plurality of circuit elements and electrically coupled to each of said ignition coil and an engine control unit outside said distributor;

a circuit receiving case receiving said circuit board; and a connecting means connecting a said ignition coil primary side connecting terminal to an outer terminal located near an outer edge region of said circuit board in said circuit receiving case, said rotation signal detector mounted in said circuit receiving case with said circuit board, said connecting means including a first receiving metallic parts receiving said primary side connecting terminal, a second receiving metallic parts receiving said outer terminal, lead wires connecting said first receiving metallic parts to said second receiving metallic parts, a lead wire case holding said lead wires and fixed with said first and second receiving metallic parts near both end portions.

13. A distributor for internal combustion engines comprising a shaft rotating synchronously with a crankshaft of an engine, a signal rotor rotatable with said shaft, a rotation signal detector for detecting a rotating angle of said crankshaft from rotation of said signal rotor, and an ignition coil for applying a high voltage to an ignition plug of each of cylinders, wherein:

said distributor further comprises a circuit board provided with a plurality of circuit elements and electrically coupled to each of said ignition coil and an engine control unit outside said distributor;

a circuit receiving case receiving said circuit board; and a car radio noise killer condenser removing noise generated in the primary circuit of said ignition coil, said rotation signal detector mounted in said circuit receiving case with said circuit board, said car radio noise killer condenser disposed on said circuit board and connected between both a first connecting terminal connecting said circuit board to said ignition coil and a second connecting terminal connecting said circuit board to a power supply for igniting outside said distributor.

14. A distributor for internal combustion engines comprising:

a shaft rotating synchronously with a crankshaft of an engine, a signal rotor rotatable with said shaft, a rotation signal detector for detecting a rotating angle of said crankshaft from rotation of said signal rotor, and an ignition coil for applying a high voltage to an ignition plug of each of cylinders, wherein:

said distributor further comprises a circuit board provided with a plurality of circuit elements and electronically coupled to each of said ignition coil and an engine control unit outside said distributor; and a circuit receiving case receiving said circuit board, said rotation signal detector including a rotation signal detecting circuit formed on said circuit board and a sensor mounted at said receiving case, said circuit receiving case formed integral with a first plug-in connecting terminal connecting said circuit board to said ignition coil, a second plug-in connecting terminal connecting said circuit board to a power supply for igniting outside said distributor, and a third plug-in connecting terminal connecting said circuit board to said engine control unit.

15. A distributor for internal combustion engines according to claim 14, wherein said circuit receiving case is made of resin, and said first connecting terminal, said second connecting terminal, and said third connecting terminal are molded integrally with said circuit receiving case.

16. A distributor for internal combustion engines according to claim 14, further comprising a connector outside said circuit receiving case, a first outer plug-in connecting terminal located in said connector and connected to said second plug-in connecting terminal, and a second outer terminal located in said connector and connected to said third plug-in connecting terminal, wherein said power supply for igniting is positioned in said engine control unit, and said connector is formed integral with said circuit receiving case and connecting said first and second outer terminals to said engine control unit.

17. A distributor for internal combustion engines according to claim 16, wherein said circuit receiving case and said connector are made of resin, and said connector is molded integrally with said circuit receiving case.

18. A distributor for internal combustion engines comprising a shaft rotating synchronously with a crankshaft of an engine, a signal rotor rotatable with said shaft, a rotation signal detector for detecting a rotating angle of said crankshaft from rotation of said signal rotor, and an ignition coil for applying a high voltage to an ignition plug of each of cylinders, wherein:

said distributor further comprises a circuit board provided with a plurality of circuit elements and electrically coupled to each of said ignition coil and an engine control unit outside each distributor;

a circuit receiving case receiving said circuit board; and a connecting means connecting a said ignition coil primary side connecting terminal to an outer terminal located near an outer edge region of said circuit board in said circuit receiving case, said rotation signal detector including a rotation signal detecting circuit formed on said circuit board and a sensor mounted at said receiving case, said connecting means including a first receiving metallic pans receiving said primary side connecting terminal, a second receiving metallic pans receiving said outer terminal, lead wires connecting said first receiving metallic pans to said second receiving metallic parts, a lead wire case holding said lead wires and fixed with said first and second receiving metallic pans near both end portions.

19. A distributor for internal combustion engines according to claim 18, wherein said case is made of resin.

20. A distributor for internal combustion engines comprising a shaft rotating synchronously with a crankshaft of an engine, a signal rotor rotatable with said shaft, a rotation signal detector for detecting a rotating angle of said crankshaft from rotation of said signal rotor, and an ignition coil for applying a high voltage to an ignition plug of each of cylinders, wherein:

said distributor further comprises a circuit board provided with a plurality of circuit elements and electrically coupled to each of said ignition coil and an engine control unit outside said distributor;

a circuit receiving case receiving said circuit board; and a car radio noise killer condenser removing noise generated in the primary circuit of said ignition coil, said rotation signal detector including a rotation signal detecting circuit formed on said circuit board and a sensor mounted at said receiving case, said car radio noise killer condenser disposed on said circuit board and connected between both a first connecting terminal connecting said circuit board to said ignition coil and a second connecting terminal connecting said circuit board to a power supply for igniting outside said distributor.

* * * * *